United States Patent [19]

Tamura

[11] Patent Number: 4,878,040

[45] Date of Patent: Oct. 31, 1989

[54] VARIABLE RESISTOR

[75] Inventor: Shigeki Tamura, Tanashi, Japan

[73] Assignee: Fostex Corporation of Japan, Tokyo, Japan

[21] Appl. No.: 159,831

[22] Filed: Feb. 24, 1988

[30] Foreign Application Priority Data

Feb. 25, 1987 [JP] Japan ..... 62-27863

[51] Int. Cl.[4] ..... H01C 10/28

[52] U.S. Cl. ..... 338/158; 338/157

[58] Field of Search ..... 338/158, 157; 29/610.1

[56] References Cited

U.S. PATENT DOCUMENTS 2,256,833 9/1941 McDonald ..... 338/158 X

FOREIGN PATENT DOCUMENTS 736755 6/1943 Fed. Rep. of Germany ..... 338/158

*Primary Examiner*—Clifford C. Shaw
*Assistant Examiner*—M. Lateef
*Attorney, Agent, or Firm*—Price, Gess & Ubell

[57] ABSTRACT

A variable resistor includes strip-shaped conductive and resistive elements on an insulator plate. A cylindrical-shaped, conductive roller element can be rolled over the conductive and resistive elements to vary resistance. Thereby, substantially all sliding movement or contact is eliminated, which eliminates noise and prevents excessive wear.

18 Claims, 1 Drawing Sheet

VARIABLE RESISTOR

BACKGROUND OF THE INVENTION

1. Field of the Invention

The present invention relates generally to variable electrical resistors and, more specifically, to an improved variable resistor that minimizes noise and wear resulting from use.

2. Description of Related Art

Conventional variable resistors have utilized a sliding element resembling a brush. The sliding element slides across a surface of a resistor element and a conductive element to vary resistance. However, noise is generated as a result of the brush element lifting from the resistor element as it slides across the resistor element and the conductive element. Obviously, noise generation becomes more of a problem as the requirement for steady resistance increases. There is the additional problem of not achieving a smooth motion by the sliding element, which also adversely affects the degree to which the variance can be controlled. The lack of smooth motion results from the large amount of friction between the sliding element and the resistor element, as well as the conductive element.

Another problem has been performance deterioration. This results from frictional wear constantly caused by the sliding element sliding across the resistor element and the conductive element each time the resistance is changed.

A need still exists in the art to provide an improved sliding type variable resistor which minimizes wear and noise.

SUMMARY OF THE INVENTION

An object of the present invention is to provide an improved strip-shaped variable resistor.

Another object of the present invention is to provide a variable resistor that minimizes the amount of wear and noise generated from use.

A further object of the present invention is to provide a sliding type variable resistor which can be used in various orientations.

The objects of the present invention are provided by a strip-shaped conductive element, a strip-shaped resistive element, and a support element or plate for supporting the conductive element and the resistive element. A contact element is also provided for electrically contacting the conductive element and the resistive element. Upon activation, the contact element remains in rolling contact with the conductive element and the resistive element while eliminating substantially all sliding contact.

These and other objects of the present invention can best be seen from an examination of the accompanying specification, the claims, and the drawings hereto.

DETAILED DESCRIPTION OF THE PREFERRED EMBODIMENTS

The following description is provided to enable any person skilled in the electrical field to make and use the present invention and sets forth the best mode contemplated by the inventors of carrying out their invention. Various modifications, however, will remain readily apparent to those skilled in the arts, since the generic principles of the present invention have been defined herein specifically to provide an improved variable resistor.

Figure 1:
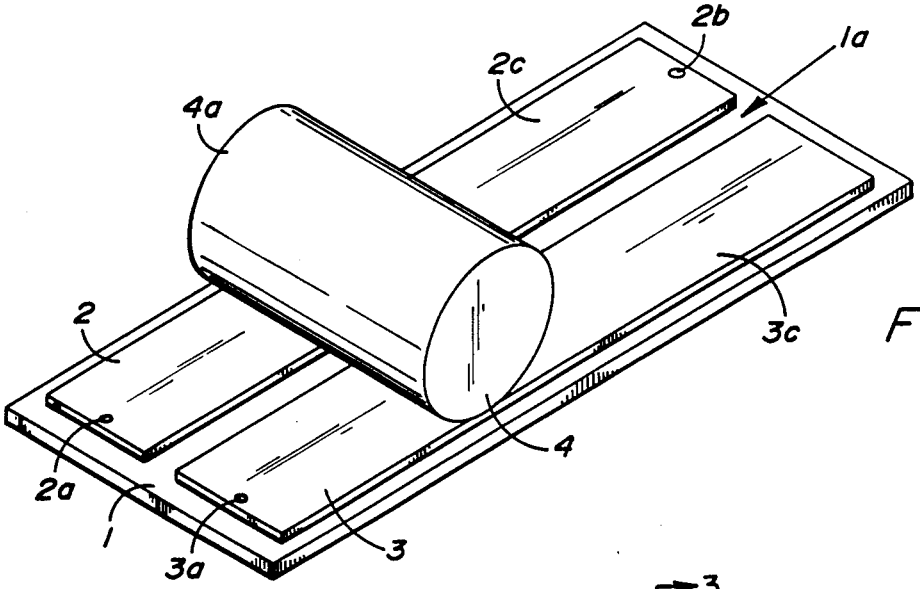
FIG. 1 is a partial, perspective view of the present invention.

FIG. 1 shows certain parts of the present invention including an insulator plate 1 which, in this particular embodiment, is planar and rectangular shaped. The insulator plate 1 is made of any appropriate conventional material that has a high insulating property and is preferably made of bakelite paper. The insulator plate 1 also has a sufficiently rigid character to prevent bending or flexing when in use.

A strip-shaped resistive element 2 is stationarily affixed to a top, planar side 1a of the insulator plate 1. For exmaple, the resistive element 2 may be adhered or may be silk screened to the plate. In this particular embodiment, the resistive element 2 is rectangular shaped and approximately less than one-half of the dimensions of the insulator plate 1. The resistive element 2 is constructed of any appropriate conventional high-resistive element, and is preferably made of a carbon coating. A pair of connecting terminals 2*a*, *b* are provided on an upper surface 2*c* of the resistive element 2. One connecting terminal is located at each opposite end along the longitudinal length of the resistive element 2. As further described below, the connecting terminals 2*a*, *b* provide an electrical connection between them and a conductive element 3.

A strip-shaped conductive element 3 is stationarily affixed to the insulator plate 1 by means similar to that of the resistive element 2. Thereby, the conductive element 3 and the resistive element 2 are positioned substantially parallel to one another on the top planar side 1a of the insulator plate 1. The conductive element 3 is configured and dimensioned like the resistive element 2. The conductive element 3 is made of any appropriate material having a high conductive property, and is preferably made of a silver coating. A connecting terminal 3*a* is provided on an upper planar surface 3*c* of the conductive element 3 at one end thereof so as to be positioned adjacent the connecting terminal 2*a*, in this particular embodiment.

A cylindrical-shaped roller element 4 is positioned above and in contact with the top planar surfaces of the resistive element 2 and the conductive element 3 to provide electrical conduction between those two elements. The roller element 4 has a smooth, rolling contact surface 4*a* that remains in rolling contact with the resistive and conductive element during variance of resistance. The roller element 4 is made of a conductive material, and is preferably made of conductive silicon rubber.

Figure 2:
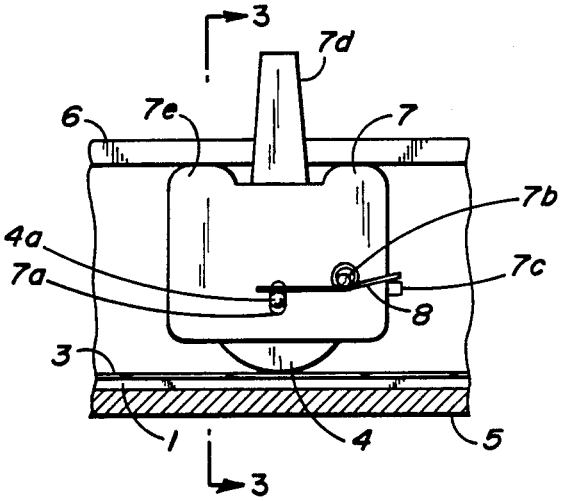
FIG. 2 is a partial side, plan view of the present invention taken across lines 2—2 in FIG. 3.
Figure 3:
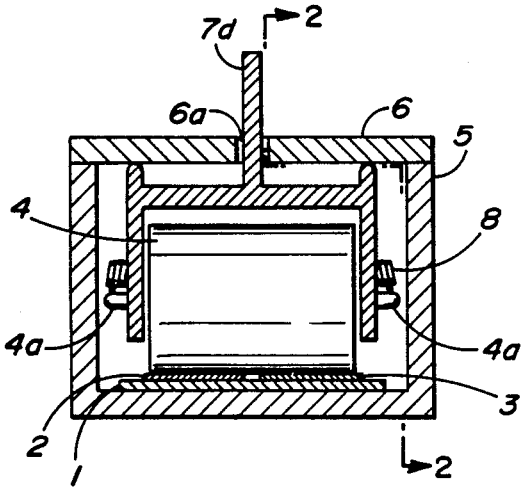
FIG. 3 is a side, cross-sectional view of the present invention taken across lines 3—3 in FIG. 2.

In FIGS. 2 and 3, a bracket 7 is provided to support and manipulate the roller element 4 across the resistive and conductive elements in their lengthwise directions. Preferably, the bracket 7 is made of nylon or polyacetal. The bracket 7 has a main body portion 7*e* that encases a top portion of the roller element 4, when viewed from FIG. 2. The main body portion 7*e* describes a pair of holes 7*a* located on opposite sides of the main body portion 7e. A roller shaft 4a is a generally rod-shaped element that extends through the main body portion 7e and has its two ends resting in the two holes 7a. The roller shaft 4a is preferably made of stainless steel and supports the roller element 4 within the main body portion 7e while enabling the roller element 4 to roll across the resistive element 2 and the conductive element 3 in the fashion described below. A pair of protrusions extend from a side of the main body portion 7e to support an end of each of two leaf spring elements 8. The other ends of the spring elements 8 rest on the ends of the roller shaft 4a, as shown in FIG. 2. As a consequence, the leaf springs 8 bias the roller shaft 4a and thereby the roller element 4 in a downward direction, when viewed from FIG. 2. Thus, the contact surface 4a is pressed into contact with the resistive and conductive elements. The biasing force also concurrently creates an upward movement of the bracket 7. The bracket 7 further includes a handle element 7d that extends in a vertical direction from a top side of the main body portion 7e.

A housing 5, preferably made of metal, encases the insulator plate 1, the resistive element 2, the conductive element 3, the roller element 4, and the main body portion 7e, as shown in FIG. 3. In this particular embodiment, the housing 5 is generally rectangular shaped. A cover element 6 is provided over a top portion of the housing 5 to enclose the above-mentioned elements. The cover 6 further describes a slit 6a that is configured to receive the handle 7d and enable the handle 7d to protrude outside of the housing 5 and the cover 6. The slit 6a extends longitudinally along the cover 6 to enable the bracket 7 to be moved longitudinally within the housing 5.

In operation, the handle 7d is moved through the slit 6a. This movement is transferred to the main body portion 7e and thus to the roller element 4. The roller element 4 thereby rolls over the resistive element 2 and the conductive strip 3 under pressure by virtue of the two spring elements 8. At the same time, the spring elements 8 are causing a top portion of the main body portion 7e to contact an underside of the cover 6. As the roller element 4 rolls over the resistive element 2 and the conductive strip 3, a rolling type of contact is produced while maintaining a substantially smooth and continuous contact. This occurs substantially without a sliding movement or contact. As the roller element 4 changes position, resistance across the connecting terminals 2a and 3a, or across connecting terminals 2b and 3a, changes to provide the required resistance value. As can be appreciated, because of the pressure contact by the roller element on the resistive element and the conductive element, the present invention can be used in not only a horizontal position, as shown in FIGS. 1–3, but also in other positions, such as a vertical one.

Alternative embodiments can provide effective performance as well. For example, rather than the type of twisted spring element 8, as shown in FIG. 2, a flat spring element having one end secured to the bracket 7 and the other end pressing against the roller shaft 4a could be employed. Further, although three connecting terminals are disclosed above, only two terminals may be provided, one of which is located on the resistive element 2 and the other on the conductive element 3.

As a result of the smoothness in rolling action, noise generation is minimized while deterioration in performance is also minimized.

While the above only describes certain embodiments of the present invention, it is contemplated that various modifications can be made to the above while still coming within the scope of the claims.

What is claimed is:

1. A method for varying electrical resistance, comprising the steps of:

providing an insulator base plate;

placing a strip-shaped conductive element on the base plate such that said conductive element extends along a longitudinal length of said base plate;

2. The invention of claim 1 further including the step of fixing the conductive element and the resistive element in one plane.

3. The invention of claim 2 wherein the step of rolling the contact surface includes the step of continuously contacting parts of the contact surface with the conductive element and the resistive element.

4. The invention of claim 3 wherein the step of applying a biasing pressure includes the step of continuously pressing the contact surface into contact with the conductive element and the resistive element.

5. The invention of claim 1 wherein the step of applying a biasing pressure includes the step of biasing said shaft against said bracket.

6. The invention of claim 1 further including the step of partially enclosing said bracket by a housing, and wherein said step of rolling said contact surface includes the step of moving said bracket within said housing and along said longitudinal length.

7. An improved variable, electrical resistor, comprising:

a strip-shaped conductive element;

a strip-shaped resistive element;

a strip-shaped support means for supporting the conductive element and the resistive element, said support means extending along a longitudinal length of said resistive and conductive elements;

a contact means for conductivity contacting the conductive element with the resistive element, the contact means, upon activation, remaining in rolling contact with the conductive element and the resistive element while eliminating substantially all sliding contact;

a bracket that surrounds said contact means; and pressure means for applying a biasing pressure on the contact means, said pressure means fixed between and on said bracket and a shaft of said contact means.

8. The invention of claim 7 further comprising pressure means for applying a biasing pressure on the contact means.

9. The invention of claim 7 wherein the pressure means includes a spring element.

10. The invention of claim 7 wherein the contact means includes a cylindrical shaped rolling contact surface.

11. The invention of claim 10 wherein the contact surface is smooth in configuration to provide continuous contact with the conductive element and the resistive element.

12. The invention of claim 11 wherein the conductive element and the resistive element are positioned parallel to one another.

13. The invention of claim 9 wherein the pressure means includes two spring elements respectively engaged to two end portions of said shaft.

14. The invention of claim 9 further including a housing that encloses said conductive and resistive elements, said contact means, and said bracket.

15. The invention of claim 14 wherein said bracket includes a handle that extends outside of said housing.

placing a strip-shaped resistive element on the base plate and parallel to the conductive element such that said resistive element extends along said longitudinal length;

enclosing a contact surface by a bracket that can be manipulated by a user;

rolling said contact surface around a shaft and, without sliding, over the conductive element and the resistive element, the step of rolling a contact surface including the step of applying a biasing pressure directly on the shaft as the contact surface rolls.

16. The invention of claim 7 wherein the support means is an insulator plate.

17. An improved variable, electrical resistor, comprising:

an insulative base plate;

a conductive element on said base plate;

an insulative element on said base plate;

a roller element supported on a shaft, said roller element in contact with said conductive and insulative elements;

a bracket that encloses said roller element and supports said shaft, said bracket having a handle that extends outside of a housing of said resistor; and a spring element on an exterior side of said bracket and engaged to said shaft such that said shaft is biased towards said conductive and resistive elements and said bracket is biased away from said conductive and resistive elements.

18. The invention of claim 17 wherein said housing includes a cover having a slit therein and through which said handle extends, said slit extending along a longitudinal length of said base plate.

* * * * *